US009874072B2

(12) United States Patent
Clement

(10) Patent No.: US 9,874,072 B2
(45) Date of Patent: Jan. 23, 2018

(54) PIPE VALVE CONTROL AND METHOD OF USE

(71) Applicant: Joseph Frederick Clement, McAllen, TX (US)

(72) Inventor: Joseph Frederick Clement, McAllen, TX (US)

( * ) Notice: Subject to any disclaimer, the term of this patent is extended or adjusted under 35 U.S.C. 154(b) by 0 days.

(21) Appl. No.: 15/676,414

(22) Filed: Aug. 14, 2017

(65) Prior Publication Data

US 2017/0342803 A1 Nov. 30, 2017

Related U.S. Application Data

(63) Continuation-in-part of application No. 14/205,057, filed on Mar. 11, 2014, now abandoned.

(60) Provisional application No. 61/787,184, filed on Mar. 15, 2013.

(51) Int. Cl.
*E21B 34/12* (2006.01)
*E21B 34/00* (2006.01)

(52) U.S. Cl.
CPC ..... *E21B 34/12* (2013.01); *E21B 2034/002* (2013.01); *E21B 2034/007* (2013.01)

(58) Field of Classification Search
CPC ..... E21B 34/12; E21B 34/08
See application file for complete search history.

(56) References Cited

U.S. PATENT DOCUMENTS

| | | | | |
|---|---|---|---|---|
| 1,706,072 | A | 3/1929 | Riegar | |
| 2,236,137 | A * | 3/1941 | Grisham | E21B 34/08 137/155 |
| 2,308,668 | A * | 1/1943 | Barstow | C09K 8/72 137/865 |
| 2,563,155 | A | 8/1951 | Cardwell | |
| 3,319,923 | A | 5/1967 | Haeber et al. | |
| 3,332,497 | A | 7/1967 | Page, Jr. | |
| 3,351,133 | A | 11/1967 | Clark, Jr. et al. | |
| 3,411,585 | A | 11/1968 | Page, Jr. | |
| 3,652,824 | A | 5/1972 | Page, Jr. | |
| 4,202,368 | A | 5/1980 | Akkerman et al. | |
| 4,460,149 | A | 7/1984 | Schaeper et al. | |
| 4,478,279 | A | 10/1984 | Puntar et al. | |
| 4,537,353 | A | 8/1985 | Fredd | |
| 4,537,383 | A | 8/1985 | Fredd | |
| 5,012,854 | A | 5/1991 | Bond | |
| 5,074,518 | A | 12/1991 | Berry | |
| 5,199,683 | A | 4/1993 | Le | |
| 5,735,502 | A | 4/1998 | Levett et al. | |

(Continued)

FOREIGN PATENT DOCUMENTS

| | | |
|---|---|---|
| EP | 0634560 | 1/1995 |
| EP | 0943781 | 9/1999 |
| EP | 1639226 | 10/2012 |

*Primary Examiner* — D. Andrews
(74) *Attorney, Agent, or Firm* — Ewing & Jones PLLC

(57) ABSTRACT

The present invention applies to flowing wells. Within a flowing well, production tubing moves fluid upward under immense pressures and is greatly exposed to damage, either accidental, or intentional. Recently, there is increased concern in protecting our production wells from damage, either natural or man-made. The present invention is designed to address the problems of controlling hydrocarbon, and fluid flow, through production tubing after the production tubing is compromised by penetration or severance.

4 Claims, 12 Drawing Sheets

(56) References Cited

U.S. PATENT DOCUMENTS

| | | | |
|---|---|---|---|
| 6,026,905 | A | 2/2000 | Garcia-Soule |
| 6,129,152 | A | 10/2000 | Hosie et al. |
| 6,257,268 | B1 | 7/2001 | Hope et al. |
| 6,321,846 | B1 | 11/2001 | Ryilewski |
| 6,644,411 | B2 | 11/2003 | Compton et al. |
| 6,907,898 | B2 | 6/2005 | White et al. |
| 7,062,960 | B2 | 6/2006 | Couren et al. |
| 7,121,295 | B2 | 10/2006 | Seneviratne et al. |
| 7,121,344 | B2 | 10/2006 | Fenton et al. |
| 7,234,527 | B2 | 6/2007 | Nivens et al. |
| 7,287,544 | B2 | 10/2007 | Seneviratne et al. |
| 7,424,917 | B2 | 9/2008 | Martin |
| 7,464,765 | B2 | 12/2008 | Isaacks et al. |
| 7,673,677 | B2 | 3/2010 | King et al. |
| 8,047,295 | B2 | 11/2011 | Skeels et al. |
| 8,443,897 | B2 | 5/2013 | Zeller |
| 8,567,490 | B2 | 10/2013 | Van Winkle |
| 8,770,274 | B2 | 7/2014 | Van Winkle |
| 8,978,698 | B2 | 3/2015 | Liotta et al. |
| 9,091,136 | B2 | 7/2015 | Allensworth et al. |
| 2011/0299930 | A1 | 12/2011 | Messina |
| 2012/0000645 | A1 | 1/2012 | Willimczik |

* cited by examiner

PIPE VALVE CONTROL AND METHOD OF USE

CROSS-REFERENCE TO RELATED APPLICATIONS

This application is a Continuation in Part, and claims priority to U.S. patent application Ser. No. 14/205,057 filed Mar. 11, 2014, and all related priority filings, which are incorporated by reference herein in their entirety. Application Ser. No. 14/205,057 claims priority to provisional application 61/787,184 filed on Mar. 15, 2013 which is incorporated by reference herein in its entirety.

STATEMENT REGARDING FEDERALLY SPONSORED RESEARCH

Not applicable.

BACKGROUND

The present invention applies to flowing fluid wells. Within a flowing well, production tubing moves fluid upward under immense pressures and is potentially exposed to great damage, either accidental, or intentional. Recently, there is increased concern in protecting our production wells from damage, either natural or man-made. The present invention is designed to address the problems of controlling hydrocarbon, and fluid flow, through production tubing after the production tubing is compromised by penetration or severance.

SUMMARY

In many embodiments of the valve design for the present invention, the present invention is placed, and/or utilized between vertical lengths of production tubing located below the water body, or between vertical lengths of production tubing in a ground based well below the Christmas Tree (i.e. within the borehole.)

In several embodiments, the present invention includes the use of an internal control valve located between vertical lengths of production tubing below the water body, or ground well. In one embodiment, the present invention includes the use of an internal control valve positioned between segments of production tubing located below the water body (the borehole), or ground well, and activated by exposure of a valve's control parts to the surrounding hydrostatic pressure above the water body, or ground well.

In one embodiment of the present invention the present invention utilizes the weight of the production tubing between the valve and the point of severance to force the valve closed. In one embodiment, the present invention uses an external control valve. In one embodiment, the present invention utilizes a valve system which combines the internal and external method of control of fluid flow.

In one embodiment, the present invention utilizes an internal control valve activated by a change in the rate and/or pressure of upward flow of the hydrocarbon. In one embodiment, the present invention envisions the use of an external control valve activated by exposure of the valve's control parts to the surrounding hydrostatic pressure above the water body. In several embodiments of the present invention it is envisioned to use the weight of the production tubing between the valve and the point of severance to force the valve closed.

In one embodiment, the present invention envisions the use of an external control valve activated by the severance of a supporting medium for an activating weight. In one embodiment, the present invention utilizes a valve system which combines any two or more of the above methods of external and/or internal control of fluid flow.

Generally, the present inventive device functions to allow for the stoppage of fluid flow through a pipe or tubing. In several embodiments, one of the novel aspects of the present invention is that it utilizes manual and hydrostatic pressures to regulate the flow of a fluid and can be re-operated through a decrease, or change, in these pressures and/or flow rates. The advantage that the invention provides is that it is a reusable valve that can be reactivated with minimal expenditure of time or resources.

In several other embodiments, another novel aspect of the present invention is that it is located subsea floor, or water body bed, and or ground well surface, and therefore is less susceptible to attack or compromise. It is envisioned that there may be multiple valves utilized in the present inventive system. It is also envisioned that the present invention can be utilized in multiple fluid flow applications outside of hydrocarbons. Many other novel advantages will be further disclosed in the detailed description of the invention.

In some embodiments, the valve is open when supported by the overlying production tubing and is closed and sealed when supported, at least, by the underlying production tubing. In some embodiments, the valve can be activated by a piston or a probe. In several embodiments, the present invention is a safe and quick shut in mechanism.

In some aspects of the present invention, the present invention is located some distance (possibly 200 or 300 feet) below the sea floor, and within the borehole (i.e. bore hole), and therefore is less susceptible to attack or compromise than valves located above the sea floor. It is envisioned that there may be multiple valves utilized in the present inventive system. It is also envisioned that the present invention can be utilized in multiple fluid flow applications outside of hydrocarbons. It is also envisioned that the present inventive device can be made with multiple individual parts, some preassembled parts, and/or some parts welded or joined together.

Some of the general principles behind the operation of the present invention may include, without limitation, the following: the rate of flow of fluids and/or hydrocarbons through the valve, the exposure of some of the valve parts to the hydrostatic pressure that exists where an embodiment of the present invention is located, which could be: a) near or around production tubing at or below the sea floor or b) near and/or surrounding all tubulars below any penetration or severance point of the production tubing below which an embodiment of the present invention is located, or c) between segments of production tubing below the sea floor. The weight of the remaining production tubing above the valve, which will cause activation of the valve when the supporting production tubing overlying the valve is severed. Severance of the mechanism of support for an external part of the valve control system, and whereby said valve is closed. A system wherein more than one valve, each activated by different functionalities that, are located within the borehole: thereby creating a backup.

In several embodiments of the present invention, the present invention comprises a flow control valve located between segments of production tubing within the borehole (i.e. bore hole) and below the sea floor, of a flowing oil and/or gas well, and wherein said location said valve is relatively secure from wanton or accidental destruction and the resulting uncontrolled and disastrous upward flow of hydrocarbon resulting from such destruction, and wherein said borehole, said valve can be closed automatically by some functionality not requiring surface control. In several embodiments of the present invention, the present invention, comprises a valve body, wherein said valve further comprising an internal sliding piston, said sliding piston having at least one perforation in its side, and further comprising a first and lower sealing surface, and said valve body containing a second and upper sealing element, whereby sufficiently increased upward flowing pressure within the production tubing below said valve makes the piston slide upward so the first sealing element engages the second sealing element, thereby closing the valve.

In several embodiments of the present invention, in said borehole said valve is activated to close by the severance of the overlying production tubing attached to, and supporting, said valve. Several embodiments of the present invention, comprise a control valve in which the severance will transfer the weight of any remaining overlying production tubing attached to the upper sliding unit of the upper valve which has a lower sealing surface, and whereby said lower sealing surface will descend to engage the upper sealing surface of the lower valve unit, and whereby said valve is closed, and the upward flow of hydrocarbon is stopped. In several embodiments of the present invention, the opening and closing of said valve can be checked without raising the valve to the surface.

In several embodiments of the present invention the borehole of said valve is activated to close by some mechanism including the severance of the mechanism of support for a moving part of a valve assembly. In several embodiments of the present invention, the present invention further comprises an upper sliding piston in mechanical communication with the overlying and attached production tubing, said upper sliding piston having a base probe projecting downward, said valve further comprising a lower sealing unit with an exposed upper trigger unit, whereby severance of the production tubing above or below the sea floor will result in the removal of support for the production tubing overlying the upper sliding piston and thereby force the sliding piston downward, whereby said probe on the base of the upper sliding piston will contact and depress the underlying trigger on the lower sealing unit, and thereby will activate the valve to close. In several embodiments of the present invention, in the control valve of many of the embodiments, when the valve is closed, restoration or replacement of the support of the severed production tubing accompanied by sufficiently increased fluid pressure above the valve, will make the piston slide downward so that the lower sealing element disengages from the uppermost sealing element, therein reopening the valve.

In several embodiments of the present invention, the valve is modified so as when the flowing well is drilled on land and the valve is activated to close by the severance of the production tubing above or below ground level. In several embodiments of the present invention, the valve can be reopened by some mechanism including temporarily reversing the flow of hydrocarbon above said valve to downward after the severed tubing is replaced. In several embodiments of the present invention, the present invention comprises a control valve located between segments of production tubing within the borehole (i.e. bore hole) of a flowing oil and or gas well, and whereby severance of said surrounding production tubing and/or a pressure chamber or pressure tube attached to said pressure chamber or valve assembly, will expose the control mechanism of said valve to that high hydrostatic pressure existing, around the riser of said well between sea level and the sea floor, and thereby close said valve. In several embodiments of the present invention, the control valve further comprises a pressure chamber in fluid communication with the control valve, a fluid line attached to said pressure chamber wherein; fluid pumped into the pressure chamber through the fluid line causes the piston to slide so the first sealing element engages the second sealing element.

In several embodiments of the present invention, a valve is located within the borehole of a flowing oil and/or gas well between segments of production tubing, and wherein said borehole said valve is activated to close by the severance of a supporting mechanism for a moveable part of said valve assembly. In several embodiments of the present invention, is a control system comprising; multiple valves which can be attached and located between units of the production tubing within the borehole. In several embodiments of the present invention, the present invention contains a control system comprising two or more of the valves. In several embodiments of the present invention, the flow control valves further contain no springs. In some wells flow sulfurous (sour) gas exists which can crystallize springs, and thereby subject them to breakage. If the springs could be eliminated, then the valve could be designed so that the flowing pressure alone would be sufficient to close it. This would be most appropriate for wells containing "sour" (sulfurous) gas which tends to crystallize springs, and whereby they break.

In several embodiments of the present invention, there is a flow control valve located between segments of production tubing within a borehole below a solid surface of a flowing oil and/or gas well, and wherein said flow control valve can be closed automatically through hydrostatic pressure change, or flow rate and not requiring surface control. In several embodiments of the present invention, the flow control valve further comprises; a valve body; said valve body further comprising an upper and lower portion said valve body further comprising an internal sliding piston, said sliding piston having at least one perforation in its side; said sliding piston further comprising a first and lower sealing surface; said valve body containing a second and upper sealing element; whereby sufficiently increased upward flowing pressure of a fluid within a production tubing below said valve makes said piston slide upward so the first sealing element engages the second sealing element, thereby closing said valve body. In several embodiments of the present invention, the flow control valve further comprises; said borehole of said flow control valve is activated to close by the severance of a production tubing attached to and supporting said flow control valve. In several embodiments of the present invention, the flow control valve further comprises; overlying production tubing; said severance will transfer the weight of any remaining overlying production tubing of said production tube attached to the upper portion of said valve body which has a lower sealing surface, and whereby said lower sealing surface will descend to engage said upper sealing surface of said flow control valve body, and whereby said flow control valve is closed, and the upward flow of hydrocarbon is stopped. In several embodiments of the present invention, the flow control valve further comprises; within said borehole the opening and closing of said flow control valve can be verified without raising the valve to the surface due fluid flow rate and/or termination by a determination of flow rate above ground.

In several embodiments of the present invention, the flow control valve further comprises; a valve assembly; wherein said borehole said valve is activated to close by the severance of the support for a moving part of a valve assembly. In several embodiments of the present invention, the flow control valve further comprises; a water body; an upper sliding piston in mechanical communication with the overlying and mechanically attached to said production tubing; said upper sliding piston having a base probe projecting downward; said valve further comprising a lower sealing unit with an exposed upper trigger unit; whereby severance of the production tubing above or below said water body will result in the removal of support for the production tubing overlying the upper sliding piston and thereby force the sliding piston downward; whereby a probe on the base of the upper sliding piston will contact and depress the underlying trigger on the lower sealing unit, and thereby activate the valve to close.

In several embodiments of the present invention, the flow control valve further comprises; a device wherein sufficiently increased fluid pressure above the valve body, will make said sliding piston slide downward so that the lower sealing element disengages from the uppermost sealing element, therein reopening the valve. In several embodiments of the present invention, the flow control valve further comprises a device wherein the flowing well is drilled on land and the fluid control valve is activated to close by the severance of the production tubing above or below ground level. In several embodiments of the present invention, the flow control valve further comprises a device wherein the valve can be reopened temporarily reversing the flow of hydrocarbon above said valve body to downward after said severed production tubing is replaced. In several embodiments of the present invention, the flow control valve further comprises; a control valve located between segments of production tubing within a borehole of a flowing oil and or gas well, under a water body and whereby severance of a pressure chamber and/or pressure tube attached to said pressure chamber or valve assembly, will expose the valve to that high hydrostatic pressure existing, around the riser of said well between sea level and the water body, and thereby closing said valve. In several embodiments of the present invention, the flow control valve further comprises; a pressure chamber in fluid communication with said control valve, a fluid line attached to said pressure chamber wherein; fluid pumped into the pressure chamber through the fluid line causes the piston to slide so a first sealing element engages a second sealing element. In several embodiments of the present invention, the flow control valve further comprises; a production tubing for fluid; a valve located between segments of said production tubing; said valve further comprising a sliding piston; said sliding piston further comprising a first sealing surface and a second sealing element; whereby increased rate of flow in the pipe below the valve makes the piston slide upward so the first sealing element engages the second sealing element therein closing the valve. In several embodiments of the present invention, the flow control valve further comprises; a sliding piston which comprises pawl. In several embodiments of the present invention, the flow control valve further comprises; a pressure chamber in fluid communication with said control valve; a fluid line attached to said pressure chamber; wherein fluid pumped into the pressure chamber through the fluid line causes the piston to slide so the first sealing element engages the second sealing element. In several embodiments of the present invention, the flow control valve further comprises; multiple valves can be located between the production tubing segments.

In some embodiments, some of the general principles behind the operation of the present inventions may include, without limitation, the following: the rate of flow of fluids and/or hydrocarbons through the valve, the exposure of some of the valve parts to the hydrostatic pressure that exists where an embodiment of the present invention is located, which could be: a) near or around production tubing at or below the sea floor, or b) near and/or surrounding all tubulars below any penetration or severance point of the production tubing below which an embodiment of the present invention is located, or c) between segments of production tubing below the sea floor. The weight of the remaining production tubing above the valve, which will cause activation of the valve when the supporting production tubing overlying the valve is severed. Severance of the mechanism of support for an external part of the valve control system and whereby said valve is closed. A system wherein more than one valve each activated by different functionalities that are located within the borehole thereby creating a backup. In one embodiment of the present invention, there is a probe supported by a cable that can be lowered in to the control valve to test the valve without having a severance or trauma issue occurring.

In several embodiments of the present invention, the present invention comprises a flow control valve located between segments of production tubing within the borehole (i.e. bore hole) and below the sea floor of a flowing oil and/or gas well, and wherein said location said valve is relatively secure from wanton or accidental destruction and the resulting uncontrolled and disastrous upward flow of hydrocarbon resulting from such destruction, and wherein said borehole, said valve can be closed automatically by some functionality not requiring surface control. In one embodiment of the present invention, there is a probe supported by a cable that can be lowered in to the control valve to test the valve without having a severance or trauma issue occurring.

In several embodiments of the present invention, the present invention comprises a valve body, wherein said valve further comprising an internal sliding piston, said sliding piston having at least one perforation in its side, and further comprising a first and lower sealing surface, and said valve body containing a second and upper sealing element, whereby sufficiently increased upward flowing pressure within the production tubing below said valve makes the piston slide upward so the first sealing element engages the second sealing element, thereby closing the valve.

In several embodiments of the present invention, in said borehole said valve is activated to close by the severance of the overlying production tubing attached to and supporting said valve. Several embodiments of the present invention, comprise a control valve in which the severance will transfer the weight of any remaining overlying production tubing attached to the upper sliding unit of the upper valve which has a lower sealing surface, and whereby said lower sealing surface will descend to engage the upper sealing surface of the lower valve unit, and whereby said valve is closed, and the upward flow of hydrocarbon is stopped.

In several embodiments of the present invention, the opening and closing of said valve can be checked without raising the valve to the surface. In one embodiment of the present invention, there is a probe supported by a cable that can be lowered in to the control valve to test the valve without having a severance or trauma issue occurring.

In several embodiments the present invention is a fluid control valve comprising: an upper chamber with an interior; a probe attached to a cable, said probe attached to a cable being capable of being suspended in said chamber with an interior; a piston chamber with an interior in communication with said upper chamber, said piston chamber further comprising a piston located in said piston chamber with an interior and a sealing plate on the bottom of said piston chamber with an interior; wherein fluid can flow through said piston chamber and into said upper chamber and thereafter out of said fluid control valve. In several embodiments, the fluid control valve of further comprises an upper casing attached to the fluid control valve and a lower casing attached to the fluid control valve. In several embodiments, when said upper casing attached to the fluid control valve supports said fluid control valve then said fluid control valve is open. In several embodiments, when said lower casing attached to the fluid control valve supports said fluid control valve then said fluid control valve is closed.

In other embodiments, the present invention has a probe attached to a cable that can be lowered through said upper chamber with an interior and come into mechanical communication with said piston, causing said piston to lower onto said sealing plate therein sealing said valve and preventing any fluid from flowing into said piston chamber or said upper chamber with an interior. In several embodiments of the present invention said probe is substantially hollow so as to allow fluid to flow through said probe.

In several embodiments of the present invention said piston is perforated distal from the center. In several embodiments of the present invention said probe attached to a cable can be raised into said upper chamber with an interior and release mechanical communication with said piston causing said piston to rise from said sealing plate therein unsealing said valve and allow fluid to flow into said piston chamber or said upper chamber with an interior.

In several embodiments the present invention is a fluid control valve comprising a body in sealed communication with a unattached tubular; an upper chamber with an interior; a probe attached to a cable, said probe attached to a cable being capable of being suspended in said chamber with an interior; a piston chamber with an interior in communication with said upper chamber, said piston chamber further comprising a piston located in said piston chamber with an interior and a sealing plate on the bottom of said piston chamber with an interior; wherein fluid can flow through said piston chamber and into said upper chamber and thereafter out of said fluid control valve.

In several embodiments of the present invention, said probe attached to a cable can be lowered through said upper chamber with an interior and come into mechanical communication with said piston causing said piston to lower onto said sealing plate therein sealing said valve and preventing any fluid from flowing into said piston chamber or said upper chamber with an interior. In several embodiments of the present invention, said probe is substantially hollow so as to allow fluid to flow through said probe. In several embodiments of the present invention, said probe attached to a cable can be raised into said upper chamber with an interior and release mechanical communication with said piston causing said piston to rise from said sealing plate therein unsealing said valve and allow fluid to flow into said piston chamber or said upper chamber with an interior. In several embodiments of the present invention, said piston is perforated distal from the center.

In several embodiments of the present invention, said body, when released from sealed communication with said unattached tubular and will move down through said unattached tubular causing said body to come into mechanical communication with said piston causing said piston to lower onto said sealing plate therein sealing said valve and preventing any fluid from flowing into said piston chamber or said upper chamber with an interior. In several embodiments of the present invention, a tongue attached to said body to assist with guiding said body through said unattached tubular if said sealed communication is broken between said body and said unattached tubular.

In several embodiments, the present invention has a method for using fluid control valve comprising the steps of: obtaining a fluid control valve with: an upper chamber with an interior; a probe attached to a cable; said probe attached to a cable being capable of being suspended in said chamber with an interior a piston chamber with an interior in communication with said upper chamber; said piston chamber further comprising a piston located in said piston chamber with an interior and a sealing plate on the bottom of said piston chamber with an interior; wherein fluid can flow through said piston chamber and into said upper chamber and thereafter out of said fluid control valve; lowering said probe attached to a cable can be lowered through said upper chamber with an interior and come into mechanical communication with said piston causing said piston to lower onto said sealing plate therein sealing said valve and preventing any fluid from flowing into said piston chamber or said upper chamber with an interior.

In some embodiments, the method further comprises the step of: raising said probe attached to a cable into said upper chamber with an interior and releasing mechanical communication with said piston causing said piston to rise from said sealing plate therein unsealing said valve and allow fluid to flow into said piston chamber or said upper chamber with an interior.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1B:
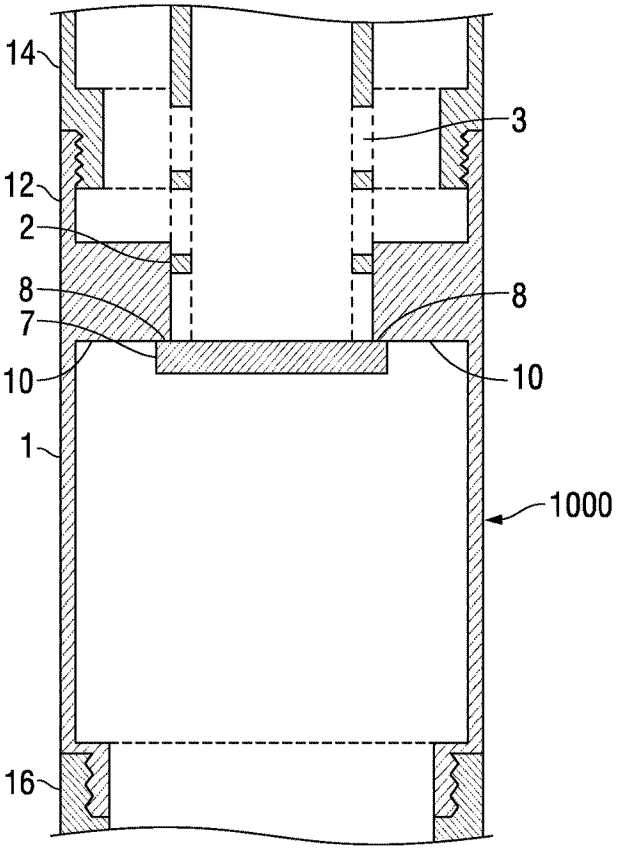
FIG. 1B illustrates one embodiment of the present invention in cross sectional view with closed flow.

One or more illustrative embodiments incorporating the invention disclosed herein are presented below. Applicant has created a revolutionary and novel pipe valve control and method of use.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that in some embodiments of the present invention, the present invention can be rotated 180 degrees and still have full functionality.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity. "Christmas Tree" as defined herein includes an oil-well control device consisting of an assembly of fittings placed at the top of the well.

One or more illustrative embodiments incorporating the invention disclosed herein are presented below. Applicants have created a revolutionary and novel pipe valve control. In many preferred embodiments of the present invention it is preferable to place the inventive valve within a borehole at some distance below the sea floor, or surface of a ground well. In many embodiments, the weight of a portion of string or piping can be sufficient to activate the valve mechanism.

In many embodiments of the present invention, several different embodiments of the invention may be used between segments of the production tubing to increase the redundancy and backup systems. In some embodiments of the present invention it is envisioned that control parts might be miniaturized and placed within the inventive valve body itself. In several embodiments of the present invention, it is envisioned that the inventive valve may be reopened by reversing the fluid flow and pressure in production tubing, thereby preventing actual removal of the inventive valve and allowing the inventive valve to be reused. In several embodiments, the internal control valve, and all component parts, are preferably composed of materials as used in normal drilling operations for drilling, drill strings, and/or well bores.

Figure 1A:
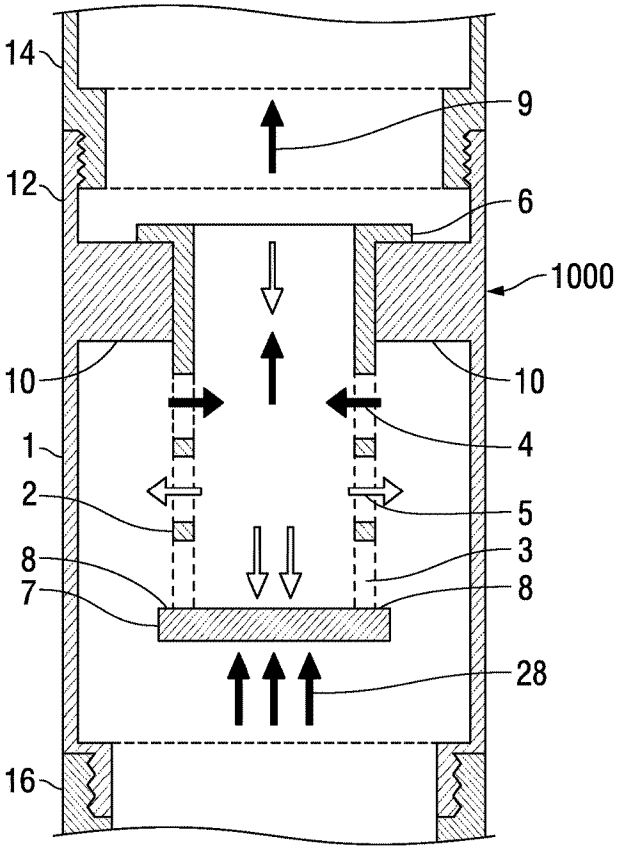
FIG. 1A illustrates one embodiment of the present invention in cross sectional view with open flow.

FIG. 1A illustrates a cross sectional view of one embodiment of the present inventive valve 1000 in open position. FIG. 1B illustrates a cross sectional view of one embodiment of the present inventive valve 1000 in closed position. As illustrated in FIG. 1A there is an internal control valve 12. In this embodiment of the present invention, the internal control valve 12, activates to close when the upward rate of fluid flow 4 exceeds a predetermined rate. This rate may vary depending on wellbore size, flow rate and other factors and should be determined in advance of application of the present inventive device. The present inventive device, in all embodiments, may be comprised of various sized, shapes and weights for component parts so as to achieve desired, and predetermined flow rates with fluid flow applications.

In this embodiment of the present invention, the valve closure of the present inventive valve 1000 is governed, in part by the weight (and port opening 3), of the sliding piston 2. Sliding piston 2 is preferably designed so that when fluid flow 4 is at a normal predetermined level. The weight of sliding piston 2 can be of sufficient mass to be in the open position during normal levels. It should be noted that various predetermined flow rates can be established and utilized in several applications of the present invention. Sliding piston 2 is preferably designed to fit within the upper sealing surface 10 and between the production tubing 14 and 16. Sliding piston 2 can also preferably be constructed with multiple flow port opening(s) 3. The flow ports or openings 3 can be constructed of varying sizes and diameters based upon the pre-established flow rate parameters.

It is envisioned that the internal control valve 12 can be attached to the production tubing in the manner known in the art for such attachments with production tubing to allow for the flow, or stoppage of flow of fluids through the internal control valve. It is for this reason that the present inventive device can be constructed in variable sizes, and weights so as to accommodate various sizes, tolerances, and requirements of drill string utilized in the industry. In one embodiment of the present invention, the internal control valve 12, activates to close when the upward rate of fluid flow 4 exceeds the predetermined rate and the valve closure is governed in part by the weight of the sliding piston 2.

In several embodiments of the present invention it is possible to lower the effective weight of the sliding piston 2 by including a hollow flotation chamber with the sealing base 7. It should be noted that various predetermined flow rates can be established and utilized in several applications of the present invention. It should also be noted, that the present invention may be constructed so as to tolerate the corrosive effects of many types of fluids that may flow through the present inventive device.

In one embodiment of the invention, the internal control valve 12, is preferably located between segments of production tubing 14 and 16, and preferably below the sea floor, although in several embodiments of the present invention, it can be located below the surface of a ground well or at another location.

In several embodiments, the internal control valve 12 preferably contains a downward facing upper sealing surface 10, which is internal and part of the valve wall 1. The valve wall 1, in this embodiment, contains, and is located adjacent to, a sliding piston 2, having side ports 3, through which hydrocarbon can flow upward 4, or downward 5, a sliding piston 2 having a sealing base 7, having a lower and upward facing sealing surface 8, and a piston flange stop 6 which limits the downward movement of the sliding piston 2.

In some embodiment of the invention, the internal control valve 12, is preferably located between segments of production tubing 14 and 16 preferably below the sea floor. In several embodiments, the internal control valve 12 preferably contains an upper sealing surface 10 which is internal and part of the valve wall 1. The valve wall 1 in this embodiment is located adjacent to a sliding piston 2, but not in mechanical communications with valve wall 1.

In some embodiments of the present invention, the sliding piston 2 has side ports 3, through which hydrocarbon can flow upward flow 4, or downward 5, a sliding piston sealing base 8, having a sealing surface 9, and a piston flange stop 6 which limits the downward movement of the sliding piston 2. It is envisioned that the individual components of the present invention can be in a variety of geometric shapes, including the ones disclosed in detail.

As shown in FIG. 1A, the fluid flow through internal control valve 12 can take place automatically, but when the lifting power of the upward rate of flow of hydrocarbon flow 4 exceed a calculated and established upward flow rate, and thereby causes the sealing base 7 to move upward, whereby the surface 8 of the sealing base 7 engages the sealing surface 10 inside the sliding piston 2 and thereby closes the valve to any upward flow 4 of hydrocarbons. The rate of the flow can be varied without removing the valve from the borehole. Under extreme circumstance (including partial penetration of the production tubing) the closing of said internal control valve 12 could be achieved by the operator severing the production tubing 14 above the mud line.

As further shown in FIGS. 1A and 1B, in some embodiments, the opening and closing ability of the flow 4 is also affected by the size of the piston port openings 3 and the weight of the sliding piston 2. The factors are easily variable; in particular, the weight within the sliding piston 2 (such as by ball bearings dropped down the annulus of the production tubing). Such weights could be removed by techniques currently known in the art to accommodate various pressure applications and parameters.

As shown in FIG. 1B, in some embodiments, closing the internal control valve 12 takes place automatically when the lifting power of the upward rate of flow of hydrocarbon flow 4 exceeds a calculated and established upward flow rate, and thereby causes the sliding piston 2 to move upward, whereby the upward facing sealing surface 8 of the sliding piston sealing base 7 engages the downward facing sealing surface 10 inside the internal control valve 12 and thereby closes the internal control valve 12 to any upward flow 28 of hydrocarbons. The normal rate of flow can be varied without removing the valve from the borehole, by using a flow meter and a normal ball valve inserted between joints of the production or collection tubing on the rig floor, as is known in the art. Under some extreme circumstance (including partial penetration of the production tubing) the closing of said internal control valve 12 could be achieved by the operator severing the production tubing 14 above the sea floor (mud line).

Figure 2B:
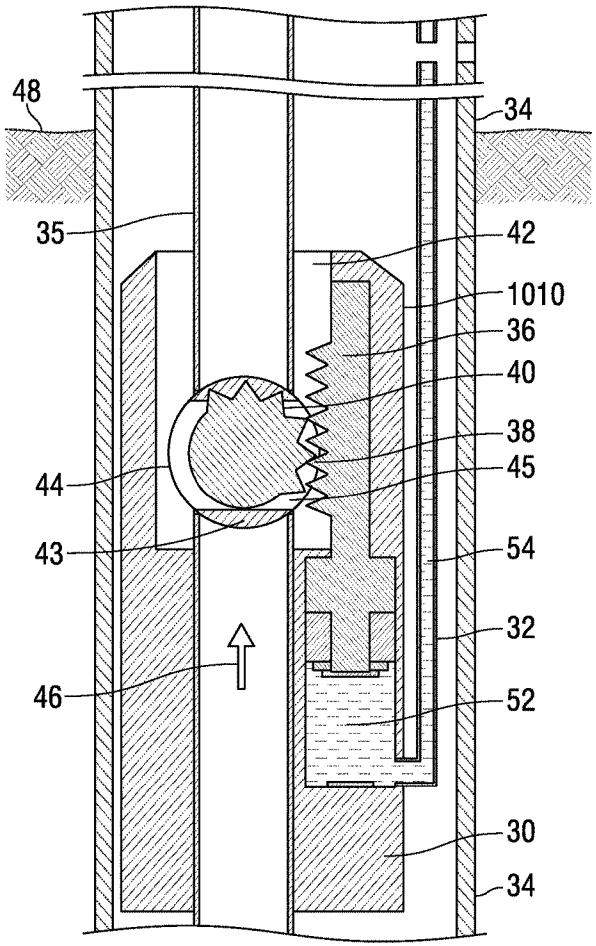
FIG. 2B-illustrates one embodiment of the present invention in cross sectional view with closed flow.
Figure 2A:
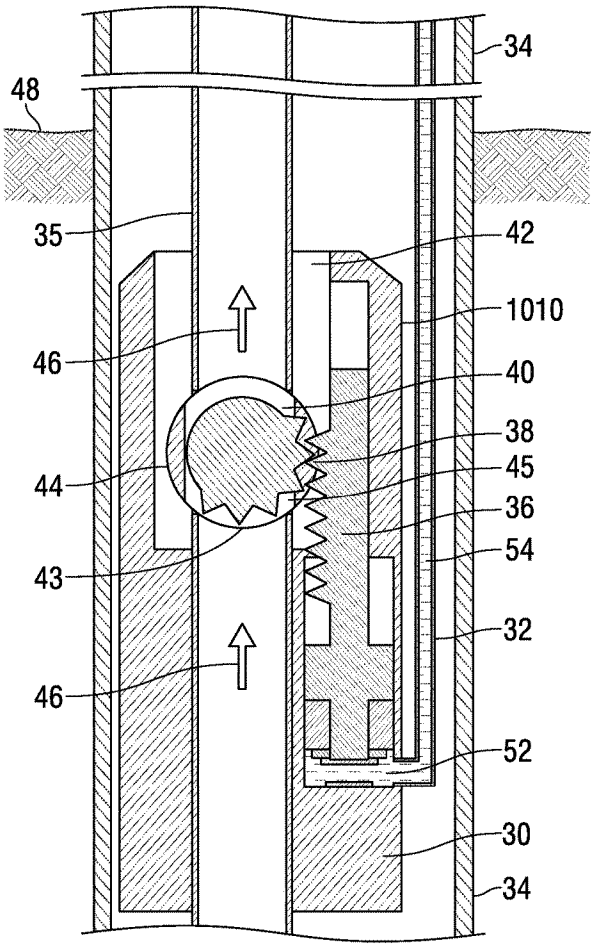
FIG. 2A-illustrates one embodiment of the present invention in cross sectional view with open flow.

FIG. 2A illustrates another embodiment of the invention 1010 with an external control valve mechanism 30 with open flow. FIG. 2B illustrates another embodiment of the invention 1010 with an external control valve mechanism 30 with closed flow. In these embodiments of the invention the control valve mechanism 30 within the riser 34 activates when the hydrostatic pressure surrounding the riser 34 and above the sea floor (or in some embodiments surface of a ground well) 48, infiltrates the control tubular 32 adjacent to the production tubing 35, as when the tubular 32 is compromised by penetration or severance. FIG. 2B. In such a case, the resulting exposure of the pressure chamber 52 and the sliding piston 36, in the valve activating mechanism 30, to the immense hydrostatic pressure of the invading seawater will cause the teeth 38 of the sliding piston 36 to rise while engaging the teeth 40 of the ratchet wheel 45 which is connected to the rotating ball 43 in the ball valve 42. In some embodiments, at this point the ball 43 will rotate within the socket 44 and thereby close and prevent the upward flow 46 of well hydrocarbons. The ratcheting of the ball valve 42 is in a fashion known in the art.

In some embodiments, when hydrostatic pressure at, or above, the sea floor (or in some embodiments surface of a ground well) 48 is lessened or removed, as and when the tubular pneumatic fluid line tubular 32 is repaired or replaced, then the ball 43 can rotate to open and restore the upward hydrocarbon flow 46, and hydrocarbon flow can resume. It is envisioned that in various permutations of the present inventive device, the piston w/pawl 36 and ball valve 42 can be of varying geometrical and solid shapes as would be known in the art to form a sealing mechanism.

In one embodiment of the present invention, it is envisioned that a hydrostatic or pneumatic fluid line 54 could be attached to the control valve mechanism 30 by which fluid could be pumped into the pressure chamber 52. In such situations pressure in the pressure chamber 52 can be controlled by an external user causing the piston 36 to be actuated by which the ratcheted teeth 40 could be raised or lowered causing the ball valve 42 to engage or disengage the socket 44. The raising, or lowering of the ball valve 42 would be actuated by decreases or increases in fluid pressure in the pressure chamber 52. Hence, increasing pressure could cause the increased fluid to push up or lower the piston 36.

In several embodiments of the present invention, as shown in FIGS. 2A and 2B, it is envisioned that the valve aspect of the present invention can be controlled externally, from the exposure to hydrostatic pressure existing at, or near, the seabed floor, automatically, when the riser and pneumatic fluid line are penetrated or severed. It is also envisioned that the external control parts could be miniaturized and contained within the invention 1010. In one such embodiment of the present invention, it is envisioned that a hydrostatic or pneumatic fluid line 54 could be attached to the control valve activating assembly mechanism 30 by which fluid could be pumped into the pressure tube or chamber 52. In such situations pressure in the pressure chamber 52 can be controlled from the surface causing the piston 36 to be actuated by which its ratcheted teeth 40 could be raised or lowered causing the ball valve 42 to engage or disengage the socket 44. Such actuation of the piston 36 would be enabled in the same manner as actuations of piston through fluid lines as is known in the art. The raising, or lowering of the ball valve 42 would be actuated by decreases or increases in fluid pressure in the pressure chamber 52.

In several embodiments, the valve aspect of the present invention can be controlled externally by pressure increase from the surface, or automatically by hydrostatic pressures when the pneumatic fluid line tubular 32 is penetrated or severed, and whereby the interior of the line and the pressure chamber 52 are exposed to the high hydrostatic pressure surrounding the production tubing below sea level and above the sea floor. In some embodiments, it is also envisioned that the external control parts could be miniaturized and contained within the valve body.

Figure 3B:
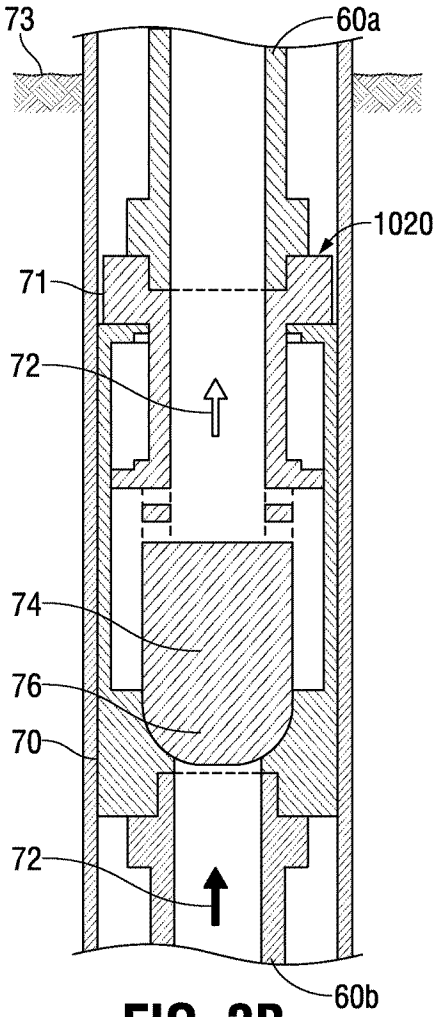
FIG. 3B-illustrates one embodiment of the present invention in cross sectional view with upward fluid flow.
Figure 3A:
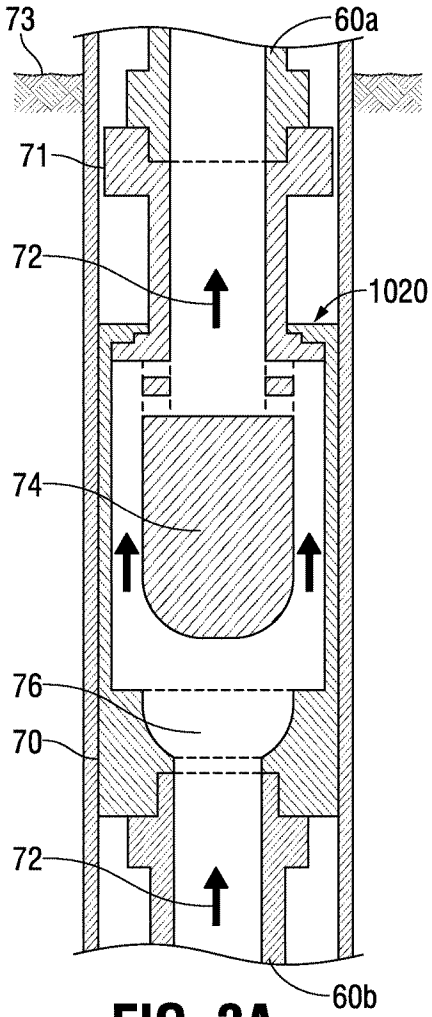
FIG. 3A-illustrates one embodiment of the present invention in cross sectional view with fluid flow blocked.

FIG. 3A illustrates another embodiment of the present invention 1020 in partial cross-sectional view in open flow state. FIG. 3B illustrates another embodiment of the present invention 1020 in partial cross-sectional view in closed flow state. As illustrated in FIG. 3B, the invention is in closed state, in which the valve 70 is activated by the depressing weight of production tubing 60*a* above the valve 70 when production tubing 60*a* above the valve 70 is severed or broken and the valve head 74 is engaged with the socket 76. Valve stop upper valve 71 is located above the valve head 74. The floor 73 is also illustrated in this embodiment. In some embodiments, the valve is open when supported by the overlying production tubing and is closed and sealed when supported, at least, by the underlying production tubing. In some embodiments, the valve can be activated by a piston or a probe. In several embodiments, the present invention is a safe and quick shut in mechanism.

As illustrated in FIGS. 3A and 3B, the embodiments of the invention, operates as follows: Fluid 72 usually flows upward through the valve 70 on the path indicated. FIG. 3A. The production tubing 60*a* is supported and attached to additional production tubing units above it when the well is flowing. In the event that the production tubing 60*b* is severed, then it is envisioned in the present invention that weight of the higher production tubing 60*a* will push downward on the valve 70 causing the valve head 74 to drop and to engage with socket 76 therein preventing the upward flow of additional fluids 72. Although illustrated as a plunger type valve, other valve configurations such as a ratchet and pawl can be utilized in the present invention instead of a plunger type valve as illustrated in FIGS. 3A and 3B.

As shown in FIG. 3A, in one embodiment, in order to open the valve 70, the production tubing 60*a* is lifted in an upward fashion, thereby lifting the valve head 74 and removing it from the socket 76. The lifting can be done in a manner known in the art for lifting production tubing. Not shown is an external and vertical tongue and groove, or similar mechanism as used in the art, between the upper valve 71 and the lower valve unit, and whose purpose would be to keep the two parts of the valve from rotating separately. As used herein, "tongue and groove" can mean a joint formed by inserting part of one surface material into a recessed area of a second surface. This joint design offers excellent stress resistance. In several embodiments of the present invention the tongue can move within the groove, but not rotate about the groove. This would mean that when the upper valve 71 is rotated then valve 70 would rotate in the same manner.

Figure 4B:
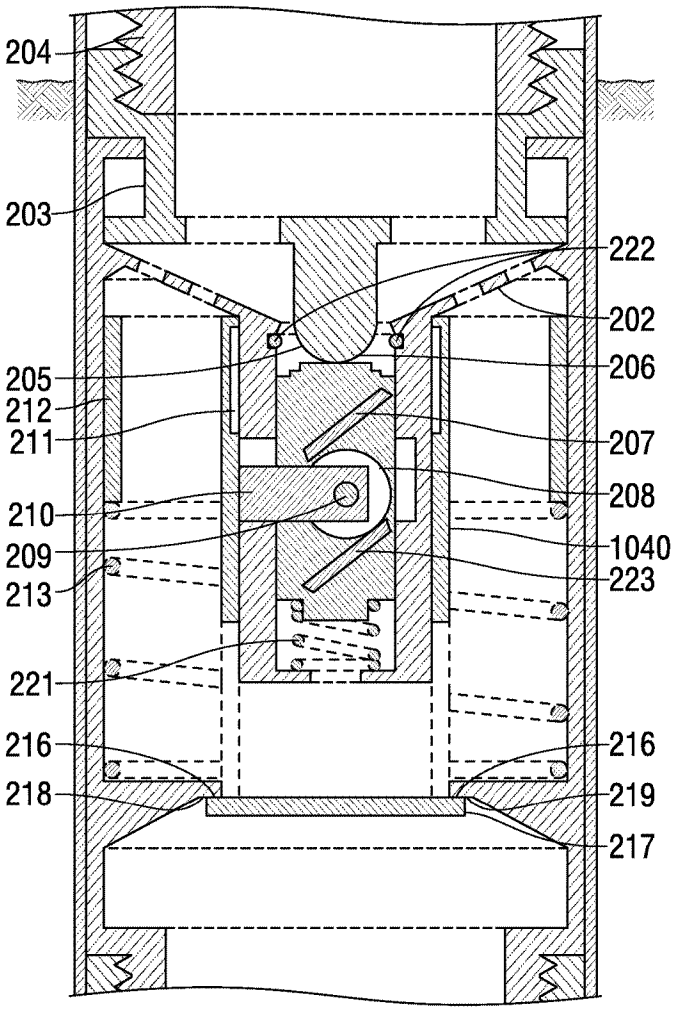
FIG. 4B illustrates one embodiment of the present invention in cross sectional view with closed flow.
Figure 4A:
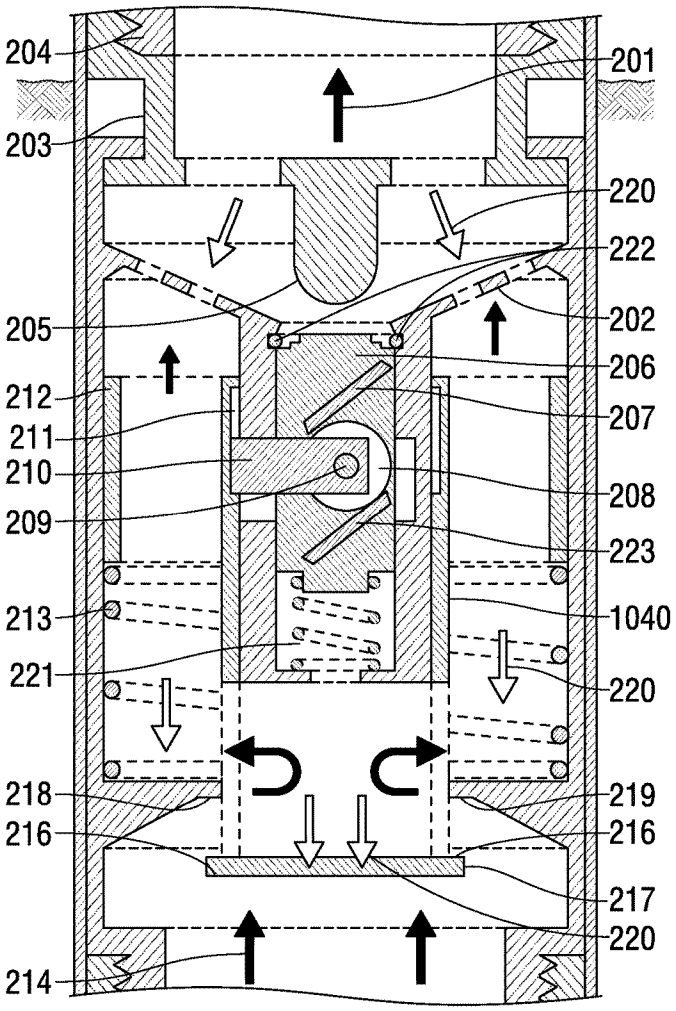
FIG. 4A illustrates one embodiment of the present invention in cross sectional view with open flow.

FIG. 4A shows another embodiment of the present invention in cross sectional view in open format. FIG. 4B shows another embodiment of the present invention in cross sectional view in closed format. One of the advantages as shown in FIG. 4B is that the valve 1040 can stay closed and sealed after overlying support is reestablished and the valve 1040 is drawn to the surface. It thereby eliminates any necessity to "kill the well flow" (by heavy mud injection) in order to pull the valve and replace it. In this embodiment, the valve 1040 can be reopened by reversing the fluid flow, temporarily to downward from upward. As shown in FIG. 4A, fluid 201 usually flows upward through the lower valve assembly 202 that is slideably attached to the upper valve 203. The upper valve 203 is normally attached to the production tubing 204, and the hydrocarbon fluid 201 usually flows along the path indicated. See FIG. 4A.

In several embodiments, the upper valve 203 is supported by many segments of production tubing 204 between it and the surface. In the event that the higher production tubing 204 is severed, it is envisioned in the present invention that the tremendous weight of the remaining and higher production tubing 204, attached to, and above, the upper valve 203, will push downward on the upper valve 203. The upper valve 203 will then descend, thereby causing the downward pointing valve head probe 205 to engage with and depress the trigger unit 206 and its attached upper cam 207. Thereby the attached upper cam 207 forces sideways the sliding piston roller 208 and its attached sliding piston pin 209 which is connected to a shear 210.

In several embodiments, the sideways motion of the sliding piston roller 208 and the sliding piston pin 209 thereby removes the shear 210 from the shear notch 211 in the sliding piston 212. As a result, the valve mainspring 213 and the upward flow of fluid 214 below the sliding piston base 217 force the upward facing surfaces 215 and 216 of the sliding piston sealing base 217 to engage in a sealing manner with the downward facing sealing surfaces 218 and 219 of the internal valve wall assembly 202 and whereby the upward flow of fluid 201 and 214 is terminated.

In some embodiments, as shown in FIGS. 4A and 4B, lifting the production tubing 204 attached to the upper valve 203 will raise the upper valve 203, thereby removing the upper valve probe 205 from the trigger unit 206. Induced downward flow 220 will push downward on the sliding piston base 217 and thereby lowering the sliding piston 212. In conjunction with this action, the trigger unit 206 is forced upward by the trigger spring 221 until it is stopped by the horizontal spring 222. This upward movement forces the lower cam 223 upward until it engages and forces the sliding piston roller 208, along with the sliding piston pin 209, sideways which forces the shear 210 back into the shear notch 211 in the sliding piston 212. The sliding piston 212 is then locked in a down (open) position when the downward flow 220 is ceased. When the sliding piston 212 is locked, and the downward flow 220 is stopped, the upward flow of fluid 201 and 214 can recommence.

In several embodiments, the following will describe closing, reopening and replacement of the weight activated valve 1040 as per FIGS. 4A and 4B. In view of FIGS. 4A and 4B, fluid 201 usually flows upward through the lower valve assembly 202 that is slidably attached to the valve 203. The valve 203 is normally attached to the production tubing 204, and the fluid 201 usually flows along the path indicated. See FIG. 4A. The valve 203 is normally attached and supported by segments of production tubing 204 above it.

In some embodiments, in the event that the higher production tubing 204 is severed, it is envisioned, in the present invention that the tremendous weight of the remaining and higher production tubing 204, attached to and above the valve head assembly 202, will push downward on the valve head assembly 202. Valve head assembly 202 will then descend, thereby causing the downward pointing valve head probe 205 to engage with and depress the trigger unit 206 and its attached upper cam 207. At this point, the attached upper cam 207 forces sideways the sliding piston roller 208 and its attached sliding piston pin 209 which it is connected to. The sideways motion of the sliding roller pin 208 thereby removing the shear 210 from the shear notch 211 in the sliding piston 212. As a result, the valve mainspring 213 and the upward flow of fluid 214 below the valve assembly 202 force the upward facing surfaces 215 and 216 of the sliding piston sealing base 217 to engage in a sealing manner with the downward facing sealing surfaces 218 and 219 of the internal valve 203 and whereby the upward flow of fluid 201 and 214 is terminated.

In some embodiments, one benefit of one embodiment of the present invention is that when the valve has been closed because of severance of the production tubing, if desirable it can be opened in place after reconnection of the production tubing by reversing the flow (as described above). If it is necessary to retrieve the valve to the surface, and the flow is not reversed, the valve will remain closed while the valve clears the rig floor.

In some embodiments, if it is necessary to replace the valve, in one embodiment of the invention, a closed system can be maintained by placing a standard ball valve (open) below the described inventive valve before the inventive valve is initially lowered in the borehole. When this standard ball valve clears the rig floor, it can be closed manually. As described in this manner, the inventive valve can be replaced without any danger of exposure to upward fluid flow through the production tubing and the standard ball valve. As described herein, the inventive valve can also be tested in place in the borehole without and danger of exposure or destruction.

Figure 5B:
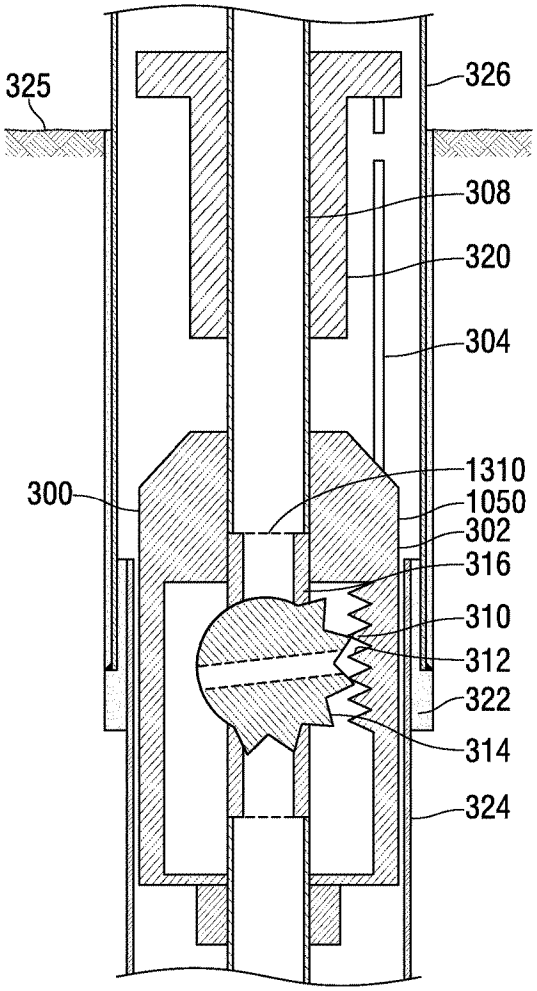
FIG. 5B-illustrates one embodiment of the present invention in cross sectional view with closed flow.
Figure 5A:
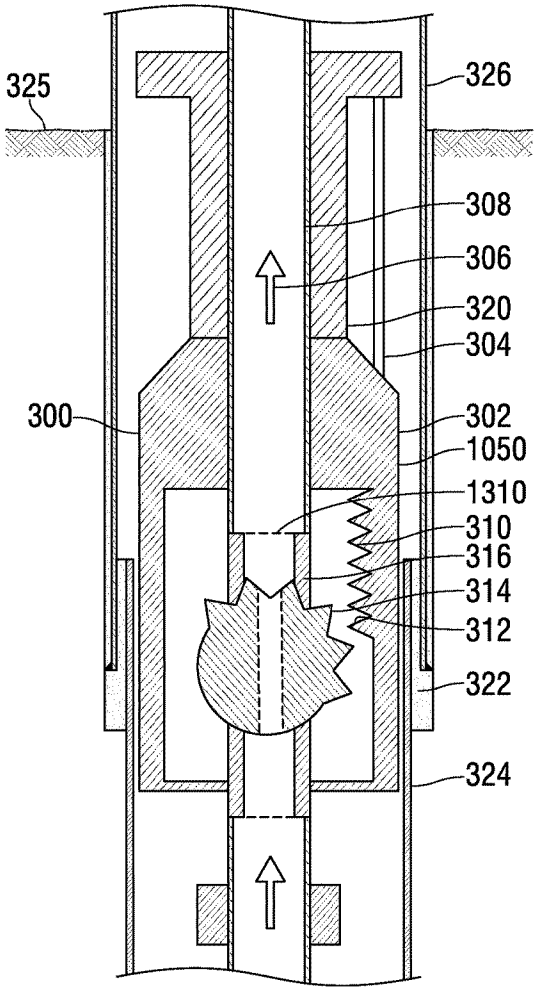
FIG. 5A illustrates one embodiment of the present invention in cross sectional view with open flow.

FIG. 5A shows one embodiment of the present invention in partial cross-sectional view in open flow. FIG. 5B shows one embodiment of the present invention in partial cross-sectional view in closed flow. As shown in FIG. 5 in one embodiment of the present invention 1050 the valve 300 is activated to close by a weighted assembly 302 positioned above the valve 300 when the line or cable or support mechanism 304 supporting the weighted assembly 302 is severed or broken. It is envisioned that the line or cable or support mechanism 304 can be any supportive mechanism as is known in the art.

As shown, this embodiment of the present invention operates as follows: Fluid 306 usually flows through the valve 300 along the upward path as shown. A weighted assembly 302 is supported by a line, cable or other support mechanism 304, attached to the production tubing 308 or on the rig floor. In the event that the support mechanism 304 is severed or broken, it is envisioned, in the present invention that the weighted assembly 302 will move downward, thereby causing the teeth 310 of the pawl 312. This movement in the weighted assembly 302 causes it to engage with the teeth of the ratchet 314 thereby rotating the ball in the socket of the ball valve 316 and preventing upward flow of fluids 306. In order to open the valve of this embodiment, the weighted assembly 302 must be lifted in an upward fashion and reattached to its original or an additional support unit of the production tubing 308 or rig floor. In some embodiments, the valve is open when supported by the overlying production tubing and is closed and sealed when supported, at least, by the underlying production tubing. In some embodiments, the valve can be activated by a piston or a probe. In several embodiments, the present invention is a safe and quick shut in mechanism. This embodiment the vector is changed from vertical to rotational.

Figure 6:
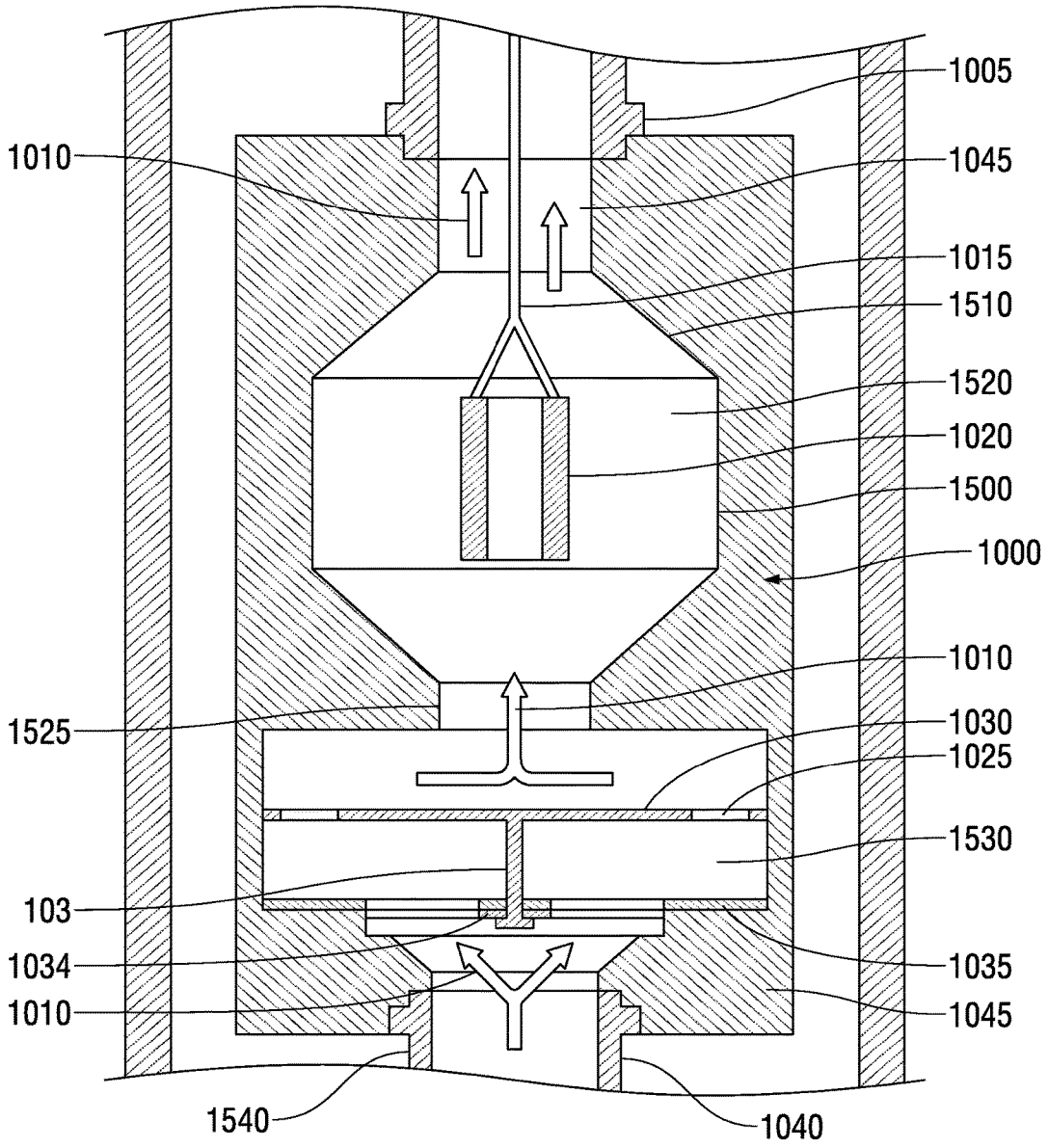
FIG. 6 illustrates one embodiment of the present invention in cross sectional view with open flow.

FIG. 6 illustrates one embodiment of the present invention in cross sectional view with open fluid flow. FIG. 6 illustrates the present invention 1000 as applied with a valve comprising one tubular 1045 and a piston 1030 (with a piston head) which is activated to close by the lowering (whether controlled or uncontrolled) of a supported probe 1020 substantially in the middle of the invention 1000. As shown, the present inventive device 1000 may be encased in an attached tubular 1045. Attached tubular 1045 is of the kind normally used in the art for sub sea oil exploration. As shown, production tubing 1005 is a mechanical attachment with attached tubular 45 in a manner as known in the art. As illustrated, production tubing 1005 is preferably on the top side of attached tubular 1045 in many embodiments. Production tubing 1005 is of the type typically used in the art.

Also, shown in FIG. 6, is valve 1500 is preferable constructed to be inside attached tubular 45. As illustrated, valve 1500 can be designed with a shape such that there is a smaller diameter upper portion 1510 larger diameter middle portion 1520 and piston housing 1530. In many embodiments, the totality of the diameter of the valve 1500 will not exceed the diameter of the tubular 1045. As shown, control cable 1015 is located substantially in the middle of valve 1500 and supports probe 1020. Cable 1015 is of the kind known in the art that can support probe 1020 inside wellbore conditions. Cable 1015 may be comprised of a pliable material capable of supporting probe 1020. In several embodiments, cable 1015 is designed to be lowered or raised throughout valve 1500. Cable 1015 is preferably attached to probe 1020 in a manner known in the art. In preferred embodiments, probe 1020 is constructed to allow for fluid to flow 1010 around probe 1020 with marginal impediment to the fluid flow 1010 rate. In some embodiments, probe 1020 is constructed as a cylinder with a hollow interior for fluid flow 1010 through. However, one of ordinary skill in the art would be able to construct probe 1020 in a variety of three dimensional geometric shapes, including, but not limited to cones, cuboids, or half spheres. In several embodiments of the present invention, probe 1020 is constructed of a material capable of withstanding pressures and the corrosive elements found in downhole drilling applications.

As shown in FIG. 6, in one embodiment of the present invention, the lower portion of valve 1500 is substantially comprised of the piston housing 1530. Piston housing 1530 is preferably designed to house piston head 1030 and lower valve sealing surface 1035. Piston 1030 is designed in several embodiments to be able to move vertically throughout piston housing 1530. Piston head 1030 is preferable created to be able to be actuated into a position of closure with lower sealing surface 1035 when fluid flow rate 1010 falls below a certain threshold, production tubing 1005 is lowered or severed, and or probe 1020 is lowered onto piston head 1030 causing the weight of probe 1020 to push piston head 1030 flush with lower sealing surface 1035.

As shown in FIG. 6, piston 1030, in some embodiments, maybe comprised with perforations 1025 that are distal to the main central stem 1033. The position of perforations 1025 can vary. In operation, perforations 1025 allow fluid flow 1010 through the piston 1030 itself. The perforations may be designed to be of the type to allow for fluid flow in a downhole drilling application as is known in the art. In several embodiments of the present invention perforations 1025 are designed to substantially align with lower valve sealing surface 1035 when piston 1030 is in a closed position therein creating a seal and preventing the further flow of fluids 1010 up through the valve 1500 and therein the production tubing 1005 as well. As illustrated, in many embodiments of the present invention, piston 1030 is constructed with a solid flat surface 1031 which has perforations 1025 distal to the main stem 1033. Main stem 1033, in many embodiments has a stabilizer 1034 on the end opposite of flat surface 1031. Stabilizer 1034 is preferably designed to prevent rotation of piston 1030 which could cause it to get lodged in production tubing 1040. Piston 1030 is preferably constructed of materials designed to withstand oil and/or gas drilling operations.

As shown in FIG. 6, in many embodiments of the present invention, the present invention operates as follows: During normal operating conditions, fluid flows 1010 from the lower portion of the valve 1540 through and around piston 30 and through valve constriction 1525 which separates piston housing 1530 from middle portion 1520. In some embodiments of the present invention, fluid flow 1010 can continue around, and in some case through probe 1020 attached by cable 1015. Fluid then flows out of upper portion 1510 and out through production tubing 1005.

Figure 7:
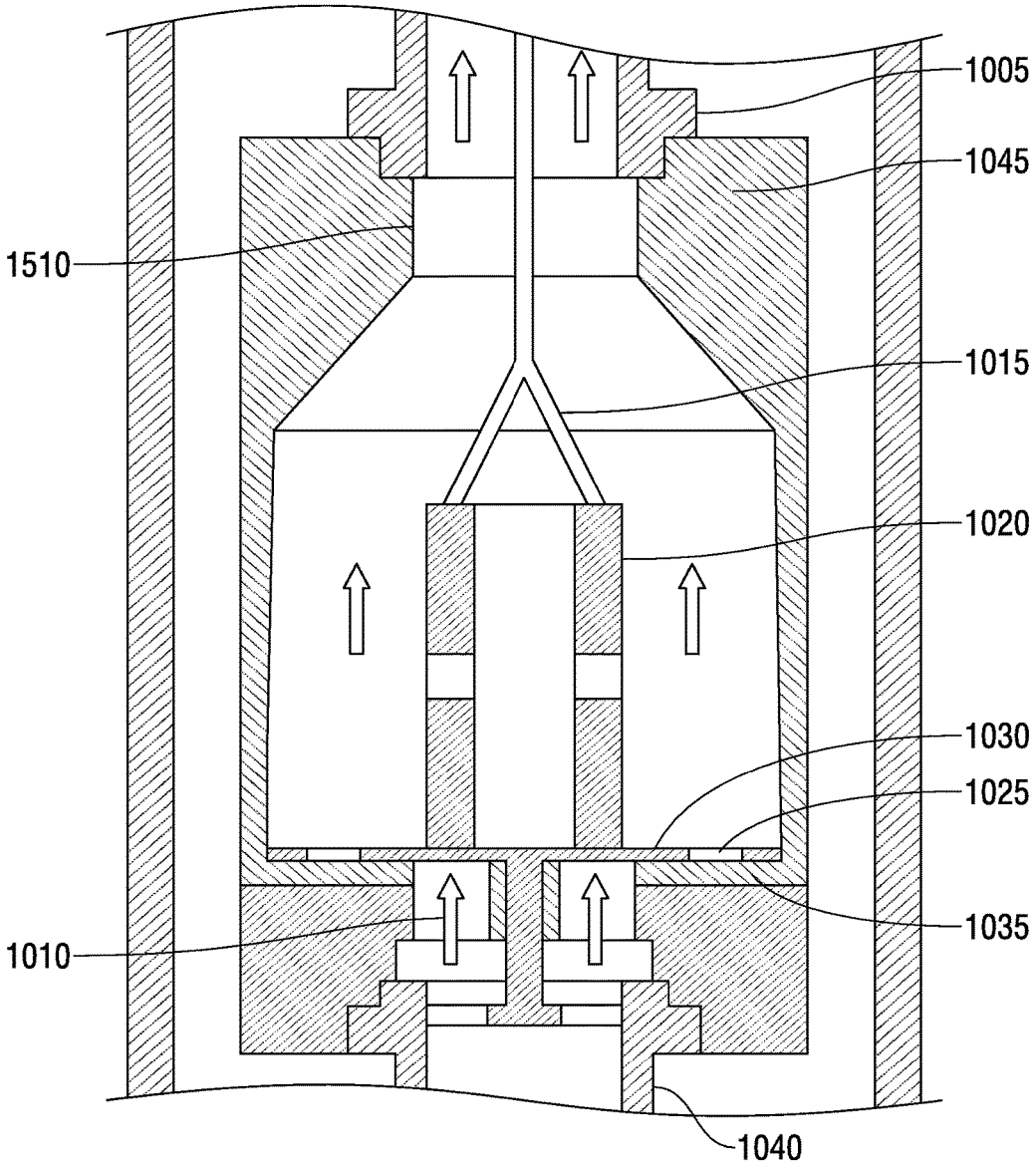
FIG. 7 illustrates one embodiment of the present invention in cross sectional view with closed flow by weight of tube.

FIG. 7, illustrates one, of many, scenarios in which probe 1020 can be lowered onto piston head 1030. In this scenario, a user can lower probe 1020 onto piston head 1030 by providing slack in cable 1015. The slack in cable 1015 allows for the weight of probe 1020 to push on piston head 1030 (due to the mass of probe 1020) and push piston head 1030 into a sealing communication with lower valve sealing surface 1035. As a seal is formed, fluid flow 1010 is impeded from proceeding past production tubing 1040. It is by this manual method of providing slack to cable 1015 that a user can test to see is piston head 1030 and valve 1020 are working properly to shut in production tubing in case of a breach or perforation of production tubing/drill string. In FIGS. 6-10 there is no need for severance of a production tubing above the valve. In some of these embodiments, the valve is open when supported by the overlying production tubing and is closed and sealed when supported, at least, by the underlying production tubing. In some embodiments, the valve can be activated by a piston or a probe. In several embodiments, the present invention is a safe and quick shut in mechanism.

Figure 8:
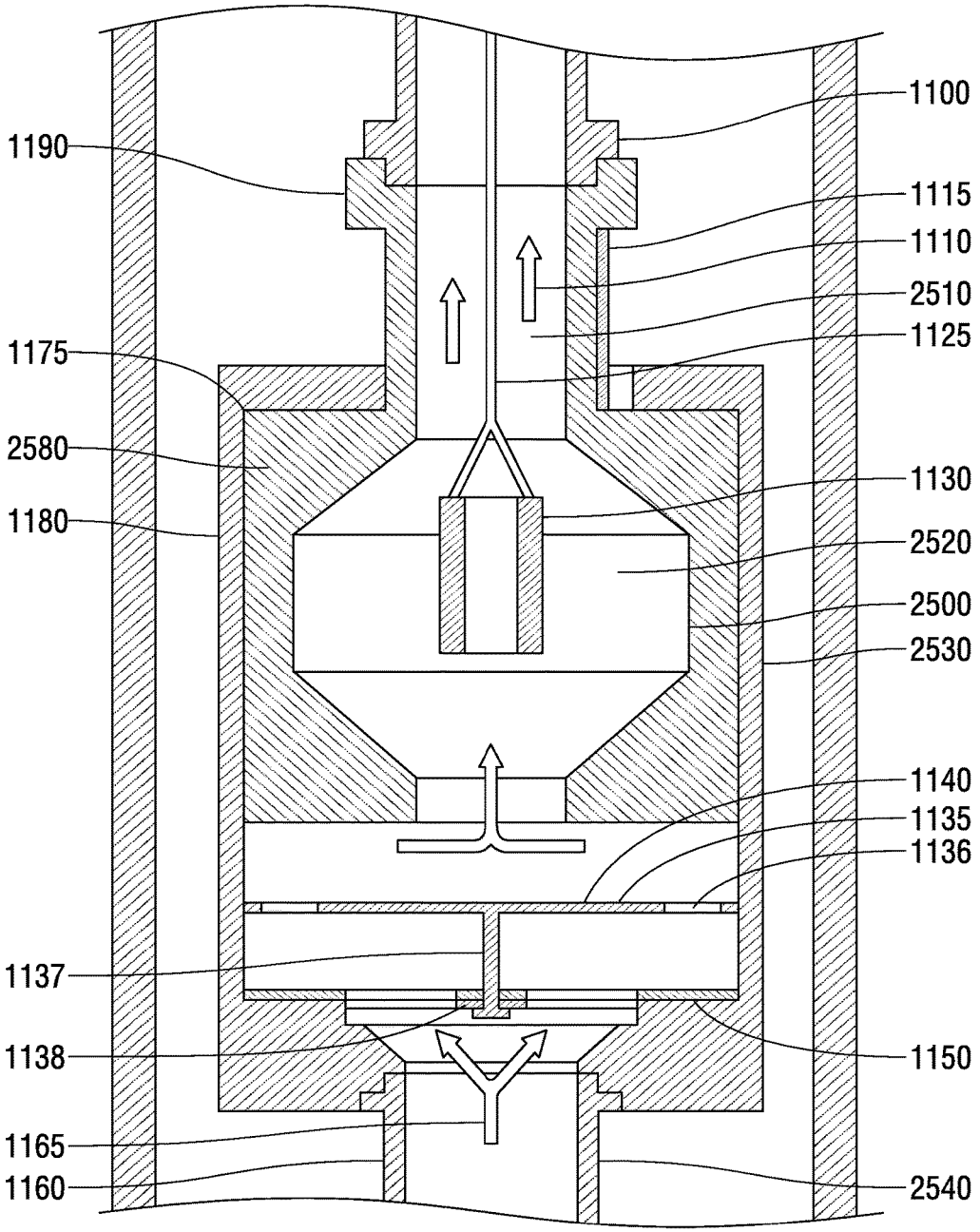
FIG. 8 illustrates one embodiment of the present invention in cross sectional view with open flow with two tubulars with double seal pistons.

As shown in FIG. 8, in one embodiment, valve 2500 is preferable constructed to be attached to tubular 1190, more specifically to production tube 1100. As illustrated, valve 2500 can be designed with a shape such that there is a smaller diameter upper portion 2510 larger diameter middle portion 2520 and piston housing 2530. In many embodiments, the totality of the diameter of the valve 2500 will not exceed the diameter of the tubular 1180. As shown, control cable 1125 is located substantially in the middle of valve 2500 and supports probe 1130. Cable 1125 is of the kind known in the art that can support probe 1130 inside wellbore conditions. Cable 1125 may be comprised of a pliable material capable of supporting probe 1130.

In several embodiments, cable 1125 is designed to be lowered or raised throughout valve 2500. Cable 1125 is attached to probe 1130 in a manner known in the art. In preferred embodiments, probe 1130 is constructed to allow for fluid to flow around probe 1130 with marginal impediment to the fluid flow rate 1110. In some embodiments, probe 1130 is constructed as a cylinder with a hollow interior for fluid flow through. However, one of ordinary skill in the art would be able to construct probe 1130 in a variety of three dimensional geometric shapes, including, but not limited to cones, cuboids, or half spheres. In several embodiments of the present invention, probe 1130 is constructed of a material capable of withstanding pressures and the corrosive elements found in downhole drilling applications. In several embodiments of the present invention tongue 1115 is attached to the upper valve tubular 1190 and runs into unattached tubular 1180. In several embodiments of the present invention unattached tubular 1180 has an interior sealing contact with valve body 2580.

As shown in FIG. 8, in several embodiments, the lower portion of valve 2500 is substantially comprised of the piston housing 2530. Piston housing 2530 is preferably designed to house piston head 1030 and lower valve sealing surface 1035. Piston 1135 is designed in several embodiments to be able to move vertically throughout piston housing. Piston head 1135 is preferable created to be able to be actuated into a position of closure with lower sealing surface 1150 when fluid flow rate 1110 falls below a certain threshold, production tubing 1100 is severed, and or probe 1130 is lowered onto piston head 1135 causing the weight of probe 1130 to push piston head 1135 flush with lower sealing surface 1150.

As shown in FIG. 8, piston 1135, in some embodiments, maybe comprised with perforations 1136 that are distal to the main central stem 1137. In operation, perforations 1136 allow fluid flow 1110 through the piston 1135 itself. The perforations maybe designed to be of the type to allow for fluid flow in a downhole drilling application as is known in the art. In several embodiments of the present invention perforations 1136 are designed to substantially align with lower valve sealing surface 1150 when piston 1135 is in a closed position therein creating a seal and preventing the further flow of fluids 1110 up through the valve 2500 and therein the production tubing 1100 as well.

As illustrated, in many embodiments of the present invention, piston 1135 is constructed with a solid flat surface 1140 which has perforations 136 distal to the main stem 1137. Main stem 1137, in many embodiments has a stabilizer 1138 on the end opposite of flat surface 1140. Stabilizer 1138 is preferably designed to prevent rotation of piston 1135 which could cause it to get lodged in production tubing 1160. Piston 1135 is preferably constructed of materials designed to withstand oil and/or gas drilling operations.

As shown in FIG. 8, in many embodiments of the present invention, the present invention operates as follows. During normal operating conditions, fluid flows 1110 from the lower portion of the valve 2540 through and around piston 1136 and through valve constriction 2525 which separates piston housing 2530 from middle portion 2520. In some embodiments of the present invention, fluid flow 1110 can continue around, and in some case through probe 1130 attached by cable 1125. Fluid then flows out of upper portion 2510 and out through production tubing 100.

Figure 9:
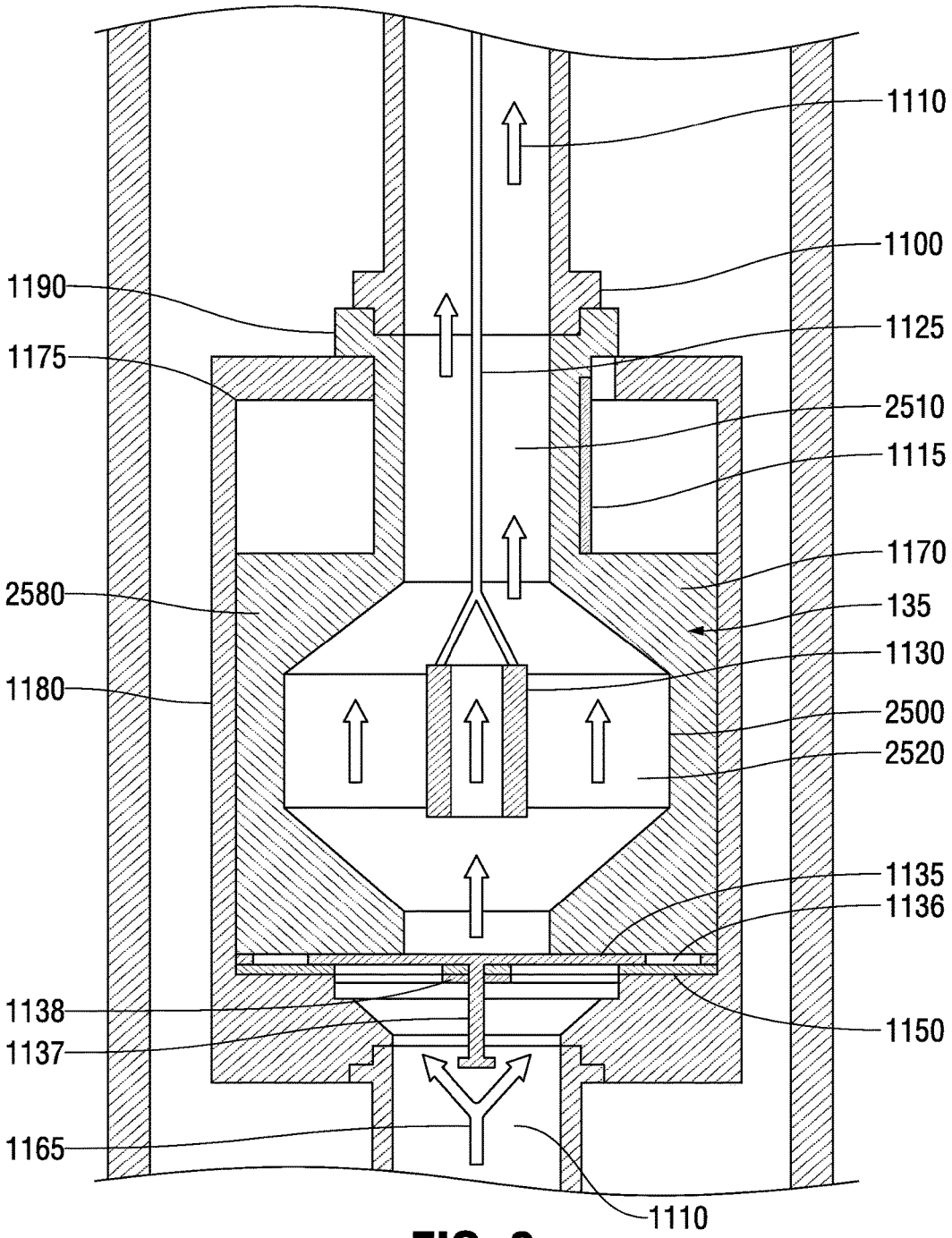
FIG. 9 illustrates one embodiment of the present invention in cross sectional view with closed flow due to severance of a production tube.

FIG. 9, illustrates one scenario in which probe 1130 is held relatively stationary in view of piston head 1135. In this scenario, however, the sealing contact 1175 is broken between the unattached tubular 1180 and the valve body 2580. When this occurs, potentially due to a breach or severance of drill string above valve 2500, valve body 2580 will fall into unattached tubular 1180 pushing valve body 2580 to compress piston housing 1170 and force piston 135 to come into sealing contact with valve sealing part 1150. In this manner, no fluid flow 1165 can proceed past production tube 1160 therein shutting of the valve 2500.

Figure 10:
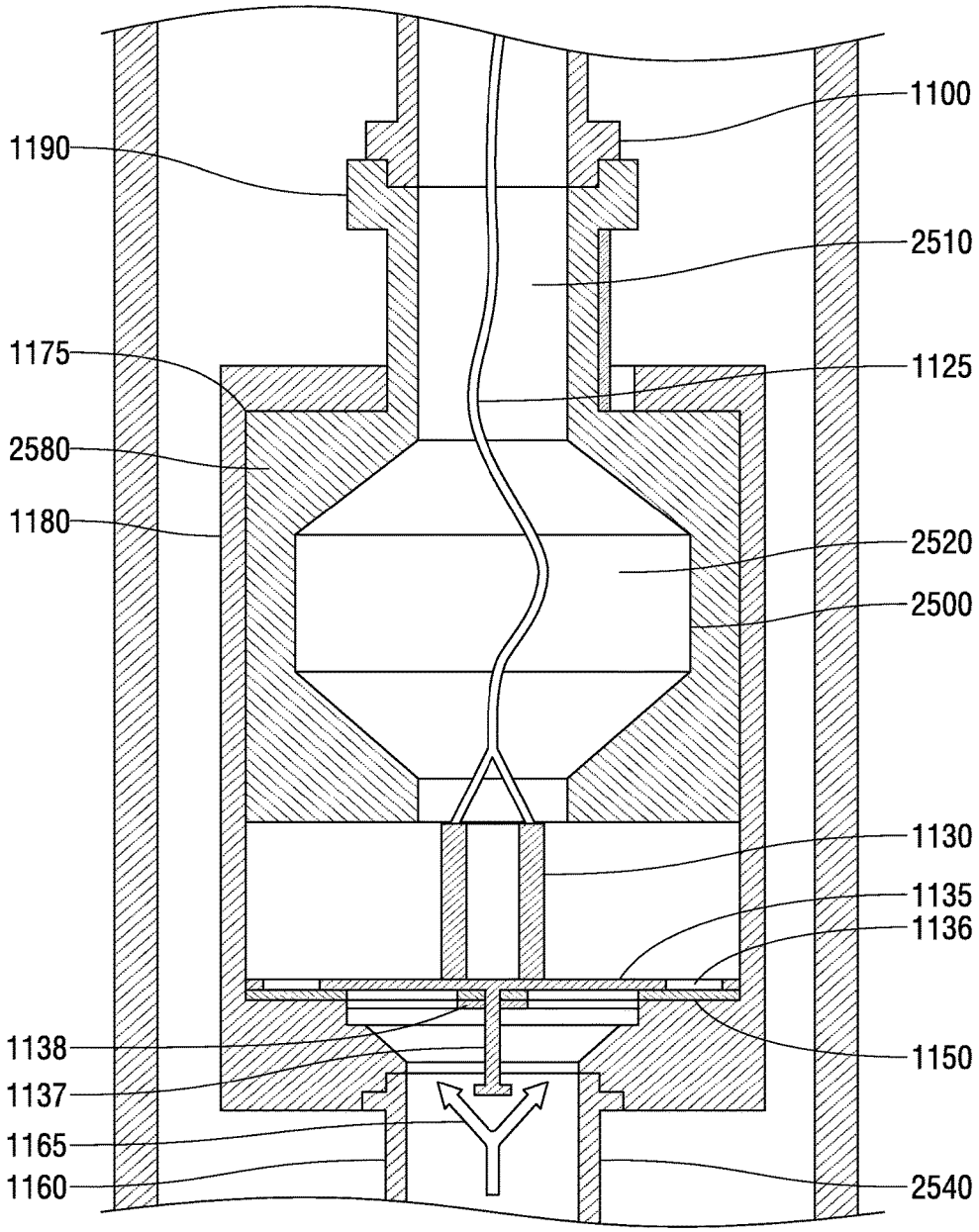
FIG. 10 illustrates one embodiment of the present invention in cross sectional view with fluid flow in open valve position with two tubulars and a sealing valve.

FIG. 10, illustrates one scenario in which probe 1130 is lowered onto piston head 1135. In this scenario, a user can lower probe 1130 onto piston head 1135 by providing slack in cable 1125. The slack in cable 1125 allows for probe 1130 to push on piston head 1135 (due to the mass of probe 1130) and push piston head 1135 into a sealing communication with lower valve sealing surface 1150. As a seal is formed, fluid flow 1110 is impeded from proceeding past production tubing 1160. It is by this manual method of providing slack to cable 1125 that a user can test to see if piston head 1135 and valve 2500 are working properly to shut in production tubing in case of a breach or perforation of production tubing/drill string.

It must be understood that in extreme emergencies the operator of the production tube and the valve of the present invention can always have the option of deciding to sever at the mud line, any and all, tubing or supporting lines necessary to close any of these valves. This is fundamental for all valves and embodiments associated with this invention. It is envisioned that in one or more of the embodiments of the present invention there can be multiple valves as described herein for increased safety and efficacy.

Figure 11:
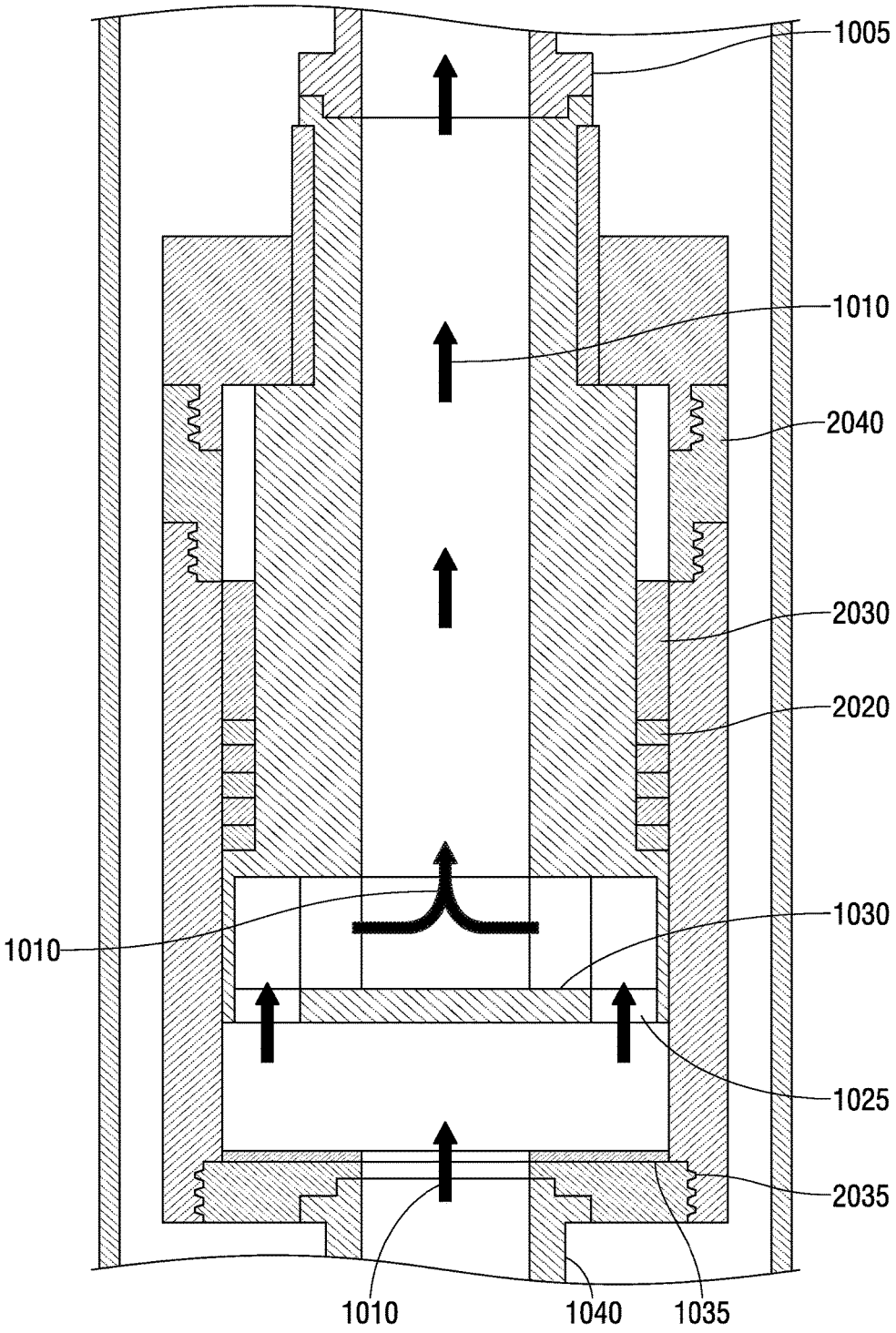
FIG. 11 illustrates a cross sectional view of another embodiment of the invention in an open position.

FIG. 11 shows one embodiment of the invention with production tubing 1005 and 1040. As shown production tubing 1040 is attached to the valve via threaded end plug 2035. On top of threaded end plug 2035 is unattached valve part sealing 1035. Attached valve 1030 is located above the unattached valve part sealing 1035 is in the open position and has perforations 1025. Further shown is packer 2020 and packer activating sliding weight cylinder 2030. Attached to packer 2020 is attached to the attached part of the valve 2047. Further, shown is extra tubular 2040. As shown, in this embodiment, the fluid 1010 is flowing upward and through the valve.

Figure 12:
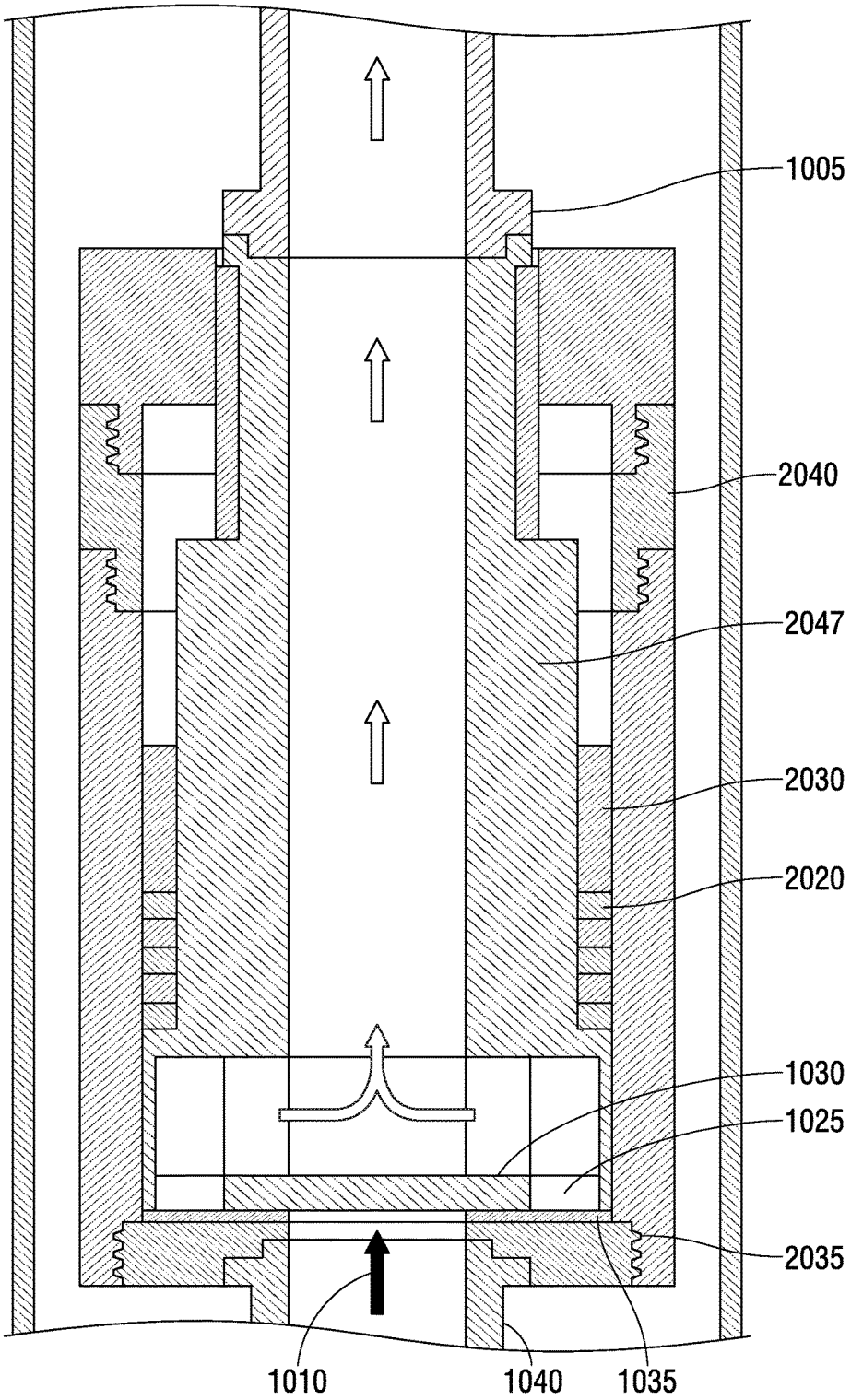
FIG. 12 illustrates a cross sectional view of another embodiment of the invention in a closed position.

FIG. 12 shows one embodiment of the invention with production tubing 1005 and 1040. As shown production tubing 1040 is attached to the valve via threaded end plug 2035. On top of threaded end plug 2035 is unattached valve part sealing 1035. Attached valve 1030 is located adjacent the unattached valve part sealing 1035 is in the closed position and has perforations 1025. Further shown is packer 2020 and packer activating sliding weight cylinder 2030. Attached to packer 2020 is attached to the attached part of the valve 2047. Further shown is extra tubular 2040. As shown, in this embodiment, the fluid 1010 is closed and not flowing through the valve. 2020, 2030, 2035 can be constructed of one piece of material in some embodiments.

It must be understood that in extreme emergencies the operator of the production tube and the valve of the present invention can always have the option of deciding to sever at the mud line, any and all, tubing or supporting lines necessary to close any of these valves. This is fundamental for all valves and embodiments associated with this invention. It is envisioned that in one or more of the embodiments of the present invention there can be multiple valves as described herein for increased safety and efficacy.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

I claim:

1. A valve attached to a production tube with an upper tubular and a lower tubular comprising;

a valve body;

said valve body is further constructed with a smaller diameter upper portion, a larger diameter middle portion, and a piston housing located in a lower portion supported by said lower tubular;

a control cable, wherein:

said control cable is located in said larger diameter middle portion and said control cable supports a probe;

said piston housing houses a piston head and a lower valve sealing surface, wherein:

said piston head is designed to move vertically throughout said piston housing, wherein:

said piston head is moveable into a position of closure with said lower valve sealing surface when said upper tubular is severed, or when said probe is lowered onto said piston head causing the weight of said probe to push said piston head flush with said lower valve sealing surface.

2. The valve of claim 1, wherein the piston head further comprises:

a central stem located below said piston head, a stabilizer to prevent rotation of said piston head, wherein said piston head further comprises perforations distal to said central stem to allow fluid flow through when said piston head is not flush with said lower valve sealing surface.

3. A valve attached to a production tube with an upper tubular and a lower tubular comprising:

a valve body;

said valve body is further constructed with a smaller diameter upper portion, a larger diameter middle portion, and a piston housing located in a lower portion supported by said lower tubular;

a control cable, wherein said control cable is located in said larger diameter middle portion and said control cable supports and is attached to a probe;

said piston housing houses a piston head and a lower valve sealing surface, wherein:

said piston head is designed to move vertically throughout said piston housing, wherein:

said piston head is moveable into a position of closure with said lower sealing surface when said upper tubular is severed moving said piston head flush with said lower valve sealing surface.

4. The valve of claim 3, wherein the piston head further comprises:

a central stem located below said piston head, a stabilizer to prevent rotation of said piston head, wherein said piston head further comprises perforations distal to said central stem to allow fluid flow through when said piston is not flush with said lower sealing surface.

* * * * *